United States Patent [19]

Stauter et al.

[11] 4,124,457

[45] Nov. 7, 1978

[54] PRODUCTION OF METALLIC LEAD

[75] Inventors: John C. Stauter, Streamwood, Ill.; Richard T. Um, Tucson, Ariz.

[73] Assignee: UOP Inc., Des Plaines, Ill.

[21] Appl. No.: 833,847

[22] Filed: Sep. 16, 1977

Related U.S. Application Data

[63] Continuation-in-part of Ser. No. 688,452, May 20, 1976, abandoned.

[51] Int. Cl.[2] ..... C25C 3/34

[52] U.S. Cl. ..... 204/66

[58] Field of Search ..... 204/66; 423/98, 494, 423/568

[56] References Cited

U.S. PATENT DOCUMENTS

| | | | |
|---|---|---|---|
| 607,287 | 7/1898 | Larsen | 423/568 |
| 1,346,642 | 7/1920 | Elmore | 423/494 |
| 1,943,340 | 1/1934 | Mitchell | 423/494 |
| 3,961,941 | 6/1976 | Baker | 204/66 |

*Primary Examiner*—Howard S. Williams
*Attorney, Agent, or Firm*—James R. Hoatson, Jr.; Raymond H. Nelson; William H. Page, II

[57] ABSTRACT

Metallic lead is obtained from lead sulfide ores or concentrates by subjecting the concentrate to a drying step followed by halogenating the dried concentrate in a dry atmosphere at a temperature in the range of 90° to about 120° C. Thereafter the halogenated mixture is subjected to a water wash and leached with a brine solution. The brine solution is then filtered to separate elemental sulfur and residue from the solubilized lead halide, the latter being then crystallized and subjected to fused salt electrolysis to recover metallic lead.

13 Claims, 1 Drawing Figure

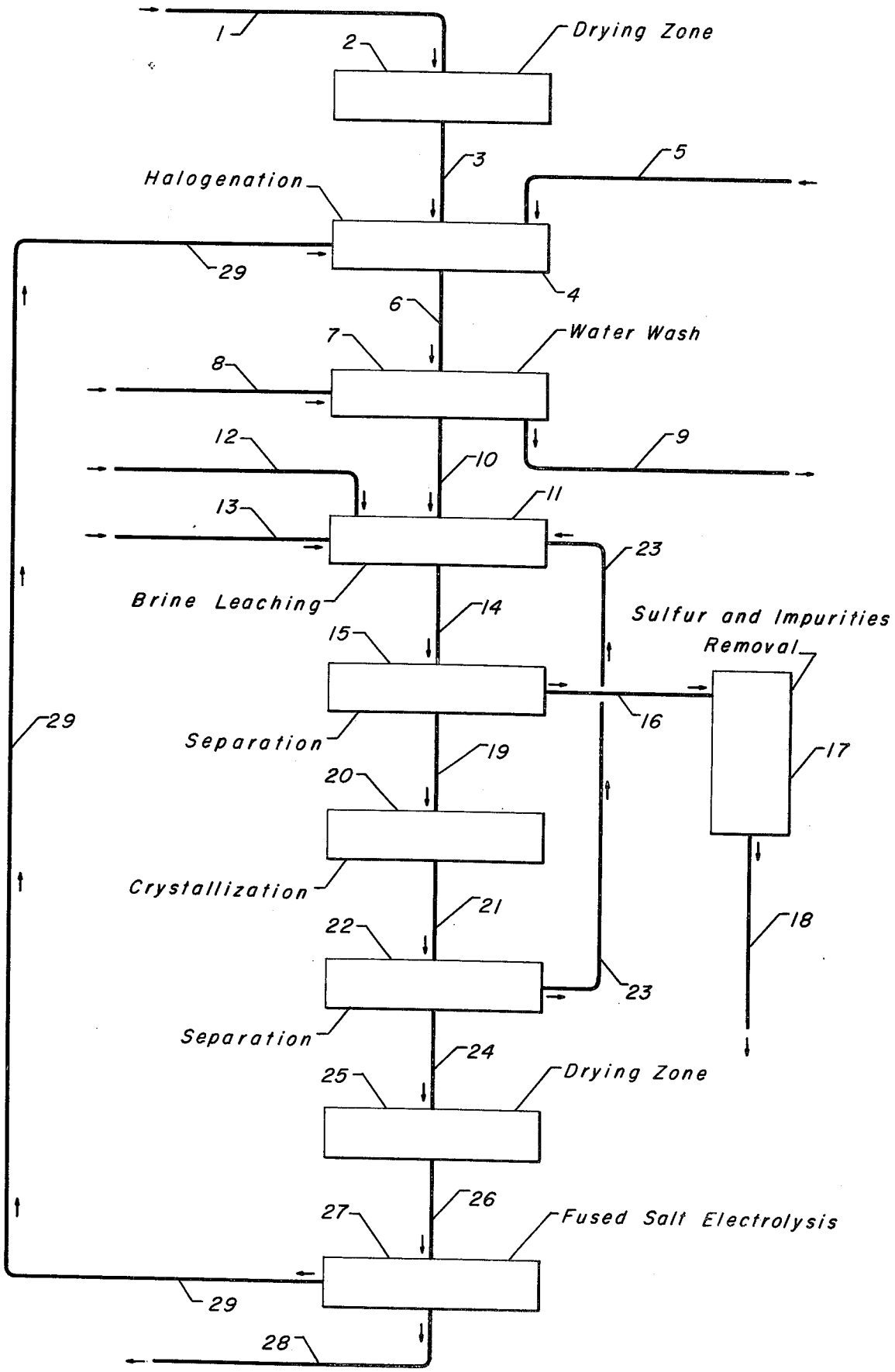
1
2
Drying Zone
3
5
Halogenation
29
4
6
7
Water Wash
8
9
12
10
11
13
23
Brine Leaching
14
Sulfur and Impurities
Removal
15
16
29
Separation
19
17
20
Crystallization
21
18
22
23
Separation
24
25
Drying Zone
26
27
Fused Salt Electrolysis
29
28

PRODUCTION OF METALLIC LEAD

CROSS-REFERENCE TO RELATED APPLICATIONS

This application is a continuation-in-part of our copending application Ser. No. 688,452 filed May 20, 1976, now abandoned all teachings of which are incorporated herein by reference thereto.

BACKGROUND OF THE INVENTION

In standard methods of obtaining metallic lead from concentrates, the standard procedure has been to treat the lead sulfide concentrates in a blast furnace. However, the pyrometallurgical procedure possesses many disadvantages and drawbacks. Primary among these disadvantages is that the process will result in some major pollution problems such as the generation of sulfur oxide gas along with substantial fuming. The fuming carries with it possible carcinogenic compounds which will contain lead, cadmium, etc. Therefore, it is necessary to provide improved and safer methods for obtaining metals such as lead in metallic or elemental form by methods which will not contribute to pollution of the air or will be safer to operate. The aforementioned lead smelting techniques will consist of roast sintering the lead sulfide concentrate whereby a major portion of the sulfur will be removed followed by melting in a blast furnace to obtain the metallic lead.

In an effort to alleviate the pollution problem, it is necessary to develop new processes for obtaining lead which will be competitive as an alternative to the conventional smelting practices. Prior work in the hydrometallurgical field resulted in developing a non-aqueous processing route whereby lead sulfide concentrates are chlorinated at temperatures above 300° C. to produce lead chloride and volatilized sulfur. However, chlorination at these elevated temperatures will promote the formation of volatile chlorides of contaminating elements such as iron, magnesium, aluminum, silicon, zinc, as well as elemental sulfur which may be present in the lead sulfide concentrate. Other hydrometallurgical processes which have been developed include the use of ferric sulfate as a leach agent. In this method, the lead sulfide is sulfated to form lead sulfate. This step is then followed by carbonation of the lead sulfate to form lead carbonate and thereafter the lead carbonate is subjected to dissolution in hydrofluosilicic acid for electrolysis to metallic lead. Yet another hydrometallurgical method which is developed for the recovery of lead is based on the use of a ferric chloride medium. This method involves a leaching step whereby the lead sulfide is converted to lead chloride and thereafter subjected to steps of solubilizing, crystallization, and electrolysis.

The prior art which exemplifies some methods of recovering lead or other metals is exemplified by U.S. Pat. No. 607,287 in which sulfide ores are chlorinated at a temperature which is high enough to cause volatilization of some metal chlorides as well as forming gaseous sulfur chlorides. However, in such a process heat does not have to be added due to the exothermic nature of the reaction, but in order to produce elemental sulfur and to minimize the conversion of impure metals, the temperature must be controlled. The chlorinated product is then leached with water which would quickly turn into a chloride leach system containing all soluble metal chlorides to a high degree. The water in this case is a scrub solution to remove the volatile chlorides and sulfur chlorides from the off-gas stream. This therefore, is not a wash process but in contradistinction is a leach process in which all metal chlorides which had been substantially converted are leached, leaving behind a residuum of sulfur and only minor amounts of unreacted sulfides. This leach or wash solution acts as the prime metal recovery step whereas, as will hereinafter be shown in greater detail, the wash step of the present invention has, for its primary aim, the removal of a small amount of unwanted metals that had been only slightly converted. Furthermore, due to the high temperature chlorination of the process of the patent it is, of necessity, a non-selective chlorination.

U.S. Pat. No. 1,346,642 describes a separation process for lead and zinc using the differential action of strong hydrochloric acid in an aqueous leach system. In this process, which is a wet chlorination process, the action is effected at a temperature of about 100° C., the hydrochloric acid converting the sulfides, except zinc, to chlorides and the sulfur to gaseous hydrogen sulfide. This treatment is not nearly as selective as the dry halogenation step of the present process, the wet acid treatment producing a greater amount of soluble zinc chloride. Furthermore, the sulfur does not remain as an innocuous solid in this process. The lead chloride and unreacted zinc sulfide are then separated from the solution containing the soluble metal chloride impurities such as iron and copper. A water wash is used to remove the entrained hydrochloric acid leach liquid in the initial leach solids and is combined with the acid leach solution forming the next series of wash. Therefore, this cold water wash actually becomes the leach solution on recycle and, as hereinbefore pointed out, will contain a relatively large amount of impurities. Inasmuch as this wash step is a displacement step to remove all of the free hydrochloric acid, it is not intended to remove the metal impurities per se, but rather to remove the solution which would continue to leach the impurities.

Another patent which is drawn to a method for recovering values from a sulfide ore is U.S. Pat. No. 1,943,340. This patent concerns a two-stage roast of zinc concentrates wherein the first step relates to the sulfation of the concentrate and the second stage relates to a chlorination. Zinc is removed after each roasting stage or step, however, there is no wash step described in this patent. Likewise, U.S. Pat. No. 3,961,941 is drawn to a method of producing metallic lead and silver from the corresponding sulfides. The patent teaches a two-stage ferric leach-brine leach process for lead concentrates and is a wet ferric chloride conversion of lead sulfide to lead chloride. The only wash step which is described in this patent involves the use of said step to wash chloride out of the process tailings before said tailings go to disposal. In contradistinction to the process of the present invention, the wash step has no effect on the resultant purity of the lead chloride precipitate.

As will hereinafter be shown in greater detail, especially in the examples appended at the end of the specification, it has now been discovered that metallic lead in a relatively pure state, may be produced in a simple and economical manner by a series of steps including the halogenation of a lead sulfide concentrate which has been subjected to a drying step prior to halogenation thereof, at a relatively low temperature in contrast to prior art methods which have involved chlorination steps at relatively high temperatures or in a wet system with the attendant formation of undesirable compounds.

This invention relates to a hydrometallurgical process for the recovery of metallic lead. More specifically, the invention is concerned with an improved process for obtaining metallic lead from lead sulfide sources or concentrates whereby unwanted side reactions are minimized, the impurities which are present in the concentrate being more totally unreacted or converted are removed in their original state thereby leading to the production of a lead halide in a purer form than has heretofore been obtainable, the end result being that the metallic lead which is recovered in the last stage of the process will be in a relatively purer state than has heretofore been possible.

It is therefore an object of this invention to provide an improved process for the production of metallic lead.

A further object of this invention is to provide a hydrometallurgical process for the production of relatively pure metallic lead from lead sulfide concentrates.

In one aspect an embodiment of this invention resides in a process for the production of metallic lead which comprises the steps of drying a lead sulfide source containing at least one metal impurity selected from the group consisting of iron, copper, zinc and cadmium, halogenating the dried lead sulfide source at a temperature in the range of from about 90° to about 120° C., water washing the halogenated mixture to remove solution halides of the slightly converted metal impurity, leaching the halogenated mixture with brine, filtering the resulting brine solution to separate elemental sulfur and residue from soluble lead halide, crystallizing said lead halide and recovering metallic lead by electrolysis.

A specific embodiment of this invention is found in a process for the production of metallic lead which comprises drying lead sulfide at a temperature in the range of from about 100° to about 150° C., chlorinating the dried lead sulfide by treatment with chlorine gas at a temperature in the range of from about 90° to about 120° C., water washing the chlorinated mixture to remove the small amount of soluble metal chloride impurities, leaching the solid residue at a temperature in the range of from about 80° to about 120° C. with a sodium chloride solution, maintaining the pH of the leaching solution in a range of from about 4 to about 8 by the addition of an acidic or caustic solution, filtering the leached mixture at a temperature in the range of from about 80° to about 120° C., crystallizing the soluble lead chloride, and recovering metallic lead by subjecting the crystallized lead chloride to a fused salt electrolysis.

Other objects and embodiments will be found in the following further detailed description of the present invention.

As hereinbefore set forth the present invention is concerned with an improvement in a hydrometallurgical process for the production of metallic lead. The feedstock which is utilized in the present process will comprise a lead sulfide source either in the form of flotation concentrates or raw feed ores which are materially rich in lead sulfide, although it is contemplated that some of the lead may be present in the form of lead carbonate or lead oxide.

In the first step of the process the feedstock is subjected to a drying operation in order to remove any water which may be present, in order that the material to be processed remains fluid during the processing operation and does not cake, and also that the evolution of water will not occur during the subsequent halogenation step to such an extent which is great enough to form significant quantities of hydrogen halide such as hydrogen chloride, hydrogen bromide, etc., or other detrimental reagents or products which could effect either the chemical or physical parameters of the process. The drying of the feedstock is effected at elevated temperatures ranging from about 100° to about 150° C., for a period of time sufficient to reduce the water content of the feed to a value of 2% or less. This drying of the feedstock within the temperature hereinbefore set forth differs from the prior art as exemplified by U.S. Pat. No. 3,961,941 in which the feedstock is subjected to an initial roast at elevated temperatures ranging from about 525° to about 900° C. under nonoxidizing conditions.

Upon completion of the drying of the feedstock and reduction of the water content the dried feed is then subjected to halogenation. In contradistinction to prior art methods hereinbefore discussed, the present invention utilizes a halogenation temperature of the lead sulfide at relatively low values ranging from about 90° to 120° C. The prior art method such as treatment of lead sulfide with a large excess of aqueous acidic ferric chloride will give elemental sulfur but this ferric chloride medium is more corrosive in nature thus necessitating the use of more expensive equipment and, in addition, is not as selective in the chlorination of lead only, more impurity metals going into solution which will come over in the filtration step along with the soluble lead chloride. The halogenation of the lead sulfide as here proposed is effected at a temperature of from 90° to about 120° C. by treating said lead sulfide with a halogenating compound such as chlorine, bromine, fluorine, etc., in a dry gaseous state. The halogenation of the lead sulfide with the aforementioned halogen gas will result in the formation of a lead halide such as lead chloride, lead bromide, or lead fluoride with the attendant formation of elemental sulfur.

In the next step of the improved hydrometallurgical process the halogenated mixture is then subjected to a water wash wherein the soluble halides of the impurity metals which are present in the feedstock will be removed prior to subjecting the mixture to a brine leaching operation and thereby facilitate the recovery of metallic lead in a purer form. The water washing of the halogenated mixture will remove such soluble metal chlorides as ferric chloride, copper chloride, zinc chloride, cadmium chloride, etc., which had only slightly been halogenated, whereby the lead which is eventually recovered will be in a purer form than that which has heretofore been obtained. The water washing of the halogenated mixture may be effected over a relatively wide range of temperatures such as from about 5° to about 95° C., the amount of water which is utilized for the washing step varying according to the method of washing the halogenated mixture. The wash water is then separated from the solid halogenated mixture and charged to a treatment step whereby the wash water may be treated for discharge or may also, if so desired, be treated for the recovery of the metallic impurities which have been removed and separated from the halogenated lead mixture. The washed solids are then leached by the addition of a brine solution at an elevated temperature usually in the range of from about 80° to about 120° C., said brine solution usually comprising an aqueous sodium chloride solution containing from about 20 to about 35% by weight of sodium chloride. During the brine leaching step, the pH of the solution is maintained in the range of from about 4 to about 8 by the addition of acidic or caustic solution such as the hydroxides and oxides of Group IA of the Periodic Table including sodium hydroxide, potassium hydroxide, lithium hydroxide, Group IIA of calcium, magnesium oxide or halogen acids such as hydrochloric acid, hydrobromic acid, etc. By controlling the pH of the brine leaching solution in the aforesaid range, other metallic impurities which are present in the solution such as copper, silver, zinc, cadmium, antimony and possibly iron along with some unreacted sulfides will reprecipitate from the solution either by hydrolysis or by reaction to form insoluble sulfides under the conditions of the solution. The leaching of the mixture is effected for a period of time which may range from about 0.25 to about 2 hours or more in duration, the residence time being that which is sufficient to dissolve the lead halide.

Upon completion of the leaching step, the solution is filtered while maintaining the temperature of the solution at an elevated range of from about 80° to about 120° C. whereby the lead halide is maintained in a soluble form. The filtrate which contains the soluble lead halide is then passed to a crystallization zone wherein the soluble lead halide is crystallized due to a temperature drop, the solubility of the lead halide decreasing as the temperature decreases.

The thus crystallized lead halide is then recovered and, in the preferred embodiment of the invention, is dried to remove any trace of water which may still be present, the drying may be effected, if so desired, by placing the lead halide in an oven and subjecting the lead halide to a temperature of about 100° C. in an atmosphere of air for a period ranging from about 0.1 to about 4 hours or more, the duration of the drying period being that which is sufficient to remove all traces of water. Following the drying of the lead halide, it is then placed in an appropriate apparatus and subjected to a temperature sufficient to melt said halide until it assumes a molten form. This temperature may range from about 380° C. which is sufficient to melt lead bromide up to about 875° C. which is sufficient to melt lead fluoride. The lead halide in molten form is then admixed with a salt of a metal selected from the group consisting of alkali metals and alkaline earth metals. Examples of these salts of metals of Groups IA and IIA of the Periodic Table will include lithium chloride, sodium chloride, potassium chloride, rubidium chloride, cesium chloride, beryllium chloride, magnesium chloride, calcium chloride, strontium chloride, barium chloride, lithium bromide, sodium bromide, potassium bromide, rubidium bromide, cesium bromide, beryllium bromide, magnesium bromide, calcium bromide, strontium bromide, barium bromide, lithium fluoride, sodium fluoride, potassium fluoride, rubidium fluoride, cesium fluoride, beryllium fluoride, magnesium fluoride, calcium fluoride, strontium fluoride, barium fluoride, etc., in a fused salt bath. In the preferred embodiment, the salt of a metal of Groups IA or IIA of the Periodic Table will be comparable in the halide content to the lead halide which is to undergo electrolysis, that is, if the lead halide is lead chloride, the solid salt will comprise a chloride such as sodium chloride, potassium chloride, lithium chloride, calcium chloride, etc. In general, the salt of the metal of Groups IA or IIA of the Periodic Table will be present in the fused salt mixture in an amount in the range of from about 20% to about 40% by weight of the mixture. It is also contemplated within the scope of this invention that the lead halide will undergo electrolysis in the presence of a mixture of at least two salts of the metals of Groups IA and IIA of the Periodic Table, examples of these mixtures comprising a sodium chloride-lithium chloride mixture, a potassium chloride-lithium chloride mixture, a magnesium chloride-calcium chloride mixture, a lithium bromide-potassium bromide mixture, etc. In the fused salt bath the mixture of salts will be subjected to electrolysis utilizing a sufficient voltage to effect said electrolysis whereby metallic lead is deposited as a liquid which can be removed from the fused salt. The lead may be removed continuously or batchwise.

The present invention will be further illustrated with reference to the accompanying drawing which illustrates a simplified flow diagram of the present process. Various valves, coolers, condensers, pumps, controllers, etc., have been eliminated as not being essential to the complete understanding of the present invention. The illustration of these, as well as other essential appurtenances will become obvious as the drawing is described.

Referring now to the drawing a charge stock of lead-containing concentrates such as that derived from Galena ores, etc., is drawn through line 1 to a drying zone 2. In drying zone 2 the ore is subjected to elevated temperatures ranging, as hereinbefore set forth, from about 100° to about 150° C. whereby the water content of the ore is substantially removed, being reduced to a value of 2% or less. By drying the charge stock prior to halogenation, the handling characteristics of the ore will be greatly improved as will the subsequent halogenation and selectivity. After being subjected to the dehydration step in drying zone 2, the dried ore is withdrawn through line 3 and passed to halogenation zone 4. A halogenating agent such as chlorine gas, fluorine gas, bromine gas, etc., is charged through line 5 to halogenation zone 4 for a period of time sufficient to convert the lead sulfide to lead halide. The halogenation of the lead sulfide to lead halide is effected at a temperature in the range of from about 90° to about 120° C. In halogenation zone 4 the treatment of the lead sulfide with the halogenating agent is accomplished in such a manner such as by stirring, mixing, shaking, fluidization, etc., whereby all of the lead sulfide is contacted with the halogenating agent. The resulting mixture of elemental sulfur and lead halide is then passed through line 6 to water wash zone 7. The mixture is contacted in water wash zone 7 with an influx of water through line 8 whereby impurities such as soluble metal halides including such compounds as ferric chloride, copper chloride, zine chloride, cadmium chloride, etc., are separated from the solid lead halide and removed through line 9. The solids comprising elemental sulfur and lead halide are then removed from water wash zone 7 through line 10 and passed to brine leaching zone 11. In leaching zone 11 the solid product is treated with an aqueous brine solution containing from about 20% to about 35% by weight of the sodium chloride, the addition of the brine solution being accomplished by passing said brine solution into leaching zone 11 through line 12. The leaching step is also effected at elevated temperatures in the range of from about 80° to about 120° C.

The pH of the brine leaching solution is maintained in a range of from about 4 to about 8 during the leaching step by the addition of a caustic solution such as sodium hydroxide, potassium hydroxide, etc., or a hydrohalic acid such as hydrochloric acid, if required, through line 13. Upon completion of the leaching step the mixture is passed through line 14 to separation zone 15 wherein the soluble lead halide solution is separated from elemental sulfur as well as any solid gangue impurities. The separation of the soluble lead halide solution and the solid sulfur may be effected by filtration or by flotation and settling whereby, after allowing the solid residue containing elemental sulfur and/or impurities to settle, the liquid is removed by conventional means such as decantation, etc. In one embodiment of the invention the solid sulfur and residue are removed through line 16 to recovery zone 17 wherein the residue which contains gangue, unreacted sulfides of the impurity metals such as zinc sulfide, copper sulfide and iron sulfide as well as elemental sulfur is subjected to a recovery treatment and removed through line 18. The elemental sulfur may be separated from the impurities and recovered by any method known in the art. One example of a recovery method which may be employed comprises a froth flotation method in which the sulfur is preferentially floated. A scrubbing step to more fully liberate sulfur from the rest of the residue may also be effected in the presence of a flotation promoter such as organic compounds readily available which include kerosene, etc. The treated material is then transferred to a flotation cell, a frothing agent is added, aeration is initiated, and the sulfur-laden froth is removed from the cell. As an alternative method for the separation and recovery of elemental sulfur from impurities, the residue may also be treated with aqueous ammonium sulfide in which the ammonium polysulfide which is formed permits the recovery of elemental sulfur in a crystalline form. In like manner the impurities comprising various metals which are present in the lead sulfide concentrate may also be recovered by conventional means which will include cyanidation of the residue in a leaching operation to recover silver or other precious metals.

A soluble lead halide solution such as lead chloride is recovered from separation zone 15 through line 19 and is passed to crystallizer 20. Inasmuch as temperature is an important factor in the solubility of lead halide, the soluble lead halide solution is maintained at an elevated temperature, preferably in a range of from about 100° to about 105° C. prior to passage into crystallizer zone 20, the crystallization zone 20 being maintained at a temperature lower than that of the leach and separation zones. Upon cooling, the lead halide will precipitate out as crystals. After crystallization of the lead halide, the solution is removed from crystallization zone 20 through line 21 to a second separation zone 22 wherein the lead halide crystals are separated from the barren leach solution. The barren leach solution may then be recycled through line 23 back to leaching zone 11 for further use therein. After separation of the lead halide crystals from the brine leach solution, the crystals are passed through line 24 to a drying zone 25 which may comprise an oven wherein all traces of water are removed by heating at an elevated temperature in excess of 100° C. for a predetermined period of time. The dried lead halide crystals are then removed from drying zone 25 through line 26 and passed to a fused salt bath 27 wherein the lead halide crystals were subjected to electrolysis in the presence of a salt of the type hereinbefore set forth. By effecting the electrolysis at an elevated temperature which is sufficient to maintain molten conditions, it is possible to remove and recover metallic lead through line 28 from fused salt electrolysis zone 27 while the halogen molecules are recycled through line 29 to halogenation zone 4. By utilizing such a flow system, it is possible, after leaching the stoichiometric quantity of halogen which is necessary to react with the lead sulfide, to reuse the halogen in a recycle or closed system thereby obviating the necessity of added halogen in any large quantities. This latter step, that is, by reusing the halogen, will contribute to the lower cost of the overall process in obtaining metallic lead from lead sulfide feedstocks.

While the above discussion has been descriptive of a continuous method of operating the process of the present invention, it is also contemplated that the recovery of metallic lead from a lead sulfide source may also be effected in a batch type operation. When this type of operation is used, the quantity of the charge stock is placed in a drying apparatus such as an oven and subjected to a drying step at a temperature within the range hereinbefore set forth. Upon completion of the drying step, the charge stock is then placed in an appropriate apparatus which is thereafter subjected to the action of a halogenating agent. Inasmuch as the halogenation of the lead sulfide is exothermic in nature the heat of reaction which is evolved will be controlled within the desired operating range hereinbefore set forth, although it is contemplated that heating or cooling means may be provided to stabilize the temperature of the reaction. Upon completion of the conversion of the lead sulfide to the desired halide, the halogenated product is then water washed to dissolve any soluble metal halide compounds other than lead which may be present as impurities in the charge stock. The water washed solid product is separated from the water by conventional means such as filtration, decantation, etc., and subjected to the action of a brine leaching solution whereby the lead halide is solubilized. After agitating the solution for a predetermined period of time sufficient to dissolve the lead halide while maintaining the pH of the solution in a range of from about 4 to about 8 by the addition of a controlled amount of caustic solution or hydrohalic acid, if necessary, the brine leaching step being effected at an elevated temperature in the range of from about 80° to about 120° C., the soluble lead halide is separated from elemental sulfur and residue and thereafter is recovered by conventional means such as filtration, decantation, etc. Upon allowing the solution to cool to a lower temperature, the lead halide will crystallize out and, after completion of the crystallization, the brine solution is separated from the solid lead halide crystals and removed in a manner similar to that hereinbefore set forth. The recovered lead halide crystals are then dried in an apparatus such as an oven at an elevated temperature in excess of 100° C. to remove water and subjected to fused salt electrolysis whereby the desired metallic lead may be recovered therefrom.

As will hereinafter be shown in the examples, it is readily apparent that, by subjecting the feedstock to a drying step prior to halogenation thereof and by also subjecting the halogenated mixture after halogenation thereof to a water washing step whereby soluble halides of metal impurities are removed, it is possible to obtain the desired metallic lead in a form which is relatively purer than that which is obtained when using conventional hydrometallurgical processes with the noncommittal presence of smaller amounts of trace elements.

The following examples are given merely for purposes of illustrating the process of the present invention. However, it is to be understood that these examples are given merely for the purpose of illustration and are not intended to limit the generally broad scope of the present invention in strict accordance therewith.

EXAMPLE I

In this example 500 grams of lead sulfide feed were placed in an oven which was then heated to a temperature of 110° C. for a period of 3 hours. Following this the feed was then placed in a flask provided with rotation means, gas inlet means and heating means comprising an adjustable heat lamp. The rotation means provided a constant reactor rotation for the agitation of the feed while the heat lamp could be adjusted to provide a constant reaction temperature. Following this, chlorine gas was charged to the reactor on a demand basis as dictated by the chlorination reaction. The temperature of the reactor was maintained in a range of from about 90° to 95° C. by controlling the input of chlorine gas as well as by providing heat from the external heat lamp source. The reaction continued to proceed for a period of 3 hours until a 94.9% conversion to lead chloride was reached. Following this, the concentrate was divided into two sections. The first section was water washed with 400 cc of water at a temperature of 25° C. for a period of 30 minutes, following which the solid reaction mixture was separated from the water. The water was analyzed and found to contain trace elements in the following amounts.

TABLE I

| Trace Element | $H_2O$ (25° C.) Wash |
|---|---|
| | ppm |
| Fe | 1000 |
| Ni | Not Detected |
| Ca | 10 |
| Mg | 42 |
| Cu | 400 |
| Mn | 180 |
| Zn | 1700 |
| Na | Not Detected |
| Al | 28 |
| Si | Not Detected |
| Ag | Present |
| Cd | Present |
| Sb | Present |

The solids comprising the lead chloride chlorination product and the elemental sulfur as well as undissolved residue was dissolved in a brine solution consisting of 500 cc of a 25% sodium chloride. The leach of the product was effected at a temperature of 100° C. while maintaining the pH of the solution at 6. The resulting slurry was agitated for a period of 0.5 hours and filtered while maintaining the temperature of the solution at 100° C. Filtration of the mixture was also accomplished at this temperature, the filtrate containing the soluble lead chloride being passed to a crystallizer which was maintained at room temperature. A portion of the leach liquor after lead chloride crystallization was removed and analyzed, the results of the analysis of the trace elements being set forth below.

TABLE II

| Trace Element | Brine Leach |
|---|---|
| | ppm |
| Fe | 280 |
| Ni | Not Detected |
| Ca | 155 |
| Mg | 13 |
| Cu | 11 |
| Mn | 310 |
| Zn | 40 |
| Na | Not Detected |
| Al | 150 |

TABLE II-continued

| Trace Element | Brine Leach |
|---|---|
| Si | Not Detected |
| Ag | Present |
| Cd | Not Detected |
| Sb | Not Detected |

The temperature drop in the crystallizer allowed the lead chloride to reprecipitate in a form which was in a state of purity sufficient to permit subsequent drying, melting at a temperature of 550° C. and admixing the melted lead chloride with sodium chloride followed by electrolysis. The electrolysis of the fused salts was effected at a temperature of 550° C. using a voltage of 2.4 volts, the desired metallic lead dropping to the cell bottom and being recovered by tapping the electrolysis apparatus.

The other portion of the lead chloride reaction product was treated with a water wash comprising 400 cc of water at a temperature of 80° C. After separation of the solid from the water, the latter was analyzed with the following results:

TABLE III

| Trace Element | $H_2O$ (80° C.) Wash |
|---|---|
| | ppm |
| Fe | 1700 |
| Ni | 4 |
| Ca | 45 |
| Mg | 93 |
| Cu | 400 |
| Mn | 390 |
| Zn | 2000 |
| Na | Not Detected |
| Al | 17 |
| Si | Not Detected |
| Ag | Present |
| Cd | Present |
| Sb | Present |

After subjecting the solid to a brine leach similar to that hereinbefore set forth, analysis of the pregnant liquor disclosed the following amounts of trace elements.

TABLE IV

| Trace Element | Brine Leach |
|---|---|
| | ppm |
| Fe | 210 |
| Ni | Not Detected |
| Ca | 215 |
| Mg | 14 |
| Cu | 6 |
| Mn | 140 |
| Zn | 40 |
| Na | Not Detected |
| Al | 150 |
| Si | Not Detected |
| Ag | Present |
| Cd | Not Detected |
| Sb | Not Detected |

In addition to comparing the content of the contaminating metals in the water wash and the brine leach another comparison was made as to the purity of the lead chloride crystals which were precipitated from the brine leaching step of the process. In Table V below, Column 1 is the analysis of lead chloride crystals which were obtained from a brine leach without first water washing the chlorinated lead sulfide prior to leaching. Column 2 is an analysis of lead chloride crystals which were obtained from a brine leaching step of chlorinated lead sulfide ore which had been water washed at a temperature of 25° C. at a point subsequent to the chlorination step and prior to brine leaching, the solid material having been separated from the water-wash liquid before leaching.

TABLE V

| | 1 ppm | 2 ppm |
|---|---|---|
| Fe | 0.05 | 0.024 |
| Ni | Not Detected | Not Detected |
| Ca | Not Detected | Not Detected |
| Mg | 0.11 | 0.024 |
| Cu | 0.046 | <0.01 |
| Mn | <0.01 | <0.01 |
| Zn | <0.3 | Not Detected |
| Na | <1 | <1 |
| Al | 0.09 | 0.06 |
| Si | 0.009 | 0.005 |
| Ag | Present | Present |
| Cd | Present | Not Detected |
| Sb | Present | Not Detected |

It is therefore readily apparent from the above tables that by subjecting the chlorinated lead product to a water wash prior to brine leaching of the product it is possible to substantially reduce the amount of impurity in the form of trace elements which are present in the feed as well as improving the purity of lead chloride which is precipitated from the brine leach and thus permit the recovery of the desired metallic lead in a substantially purer form.

EXAMPLE II

In a manner similar to that set forth in the above examples, 500 grams of lead sulfide feed may be placed in an oven and heated to a temperature of 110° C. for a period of time sufficient to remove a major portion of the water which is present in the feed, the amount of water remaining being less than 2%. Thereafter the lead sulfide feed may be charged to a flask provided with heating means and rotating means. The feed may be continuously agitated while charging fluorine gas to the reactor on a demand basis. The temperature of the reactor may be maintained at about 110° C. by utilizing the heating means to initiate the temperature rise following which the exothermic nature of the reaction will be of a sufficient level so as to permit maintenance of the temperature at the desired level. The fluorination of the lead sulfide feed may be allowed to proceed for a period of 2 hours, at the end of which time the input of fluorine gas may be discontinued and the fluorinated product recovered.

Thereafter the lead fluorine product may be water washed with 500 cc of water whereby soluble metal fluorides are separated from the solid lead fluoride. After separation of the solid and liquid, the solid lead fluoride product may be dissolved in a sufficient quantity of a 25% sodium fluoride brine solution at a temperature of 110° C. for a period of 0.5 hours while maintaining continuous agitation. During the 0.5 hour residence time, the pH of the solution may be maintained in a range of from about 4 to about 8 by the introduction of a sodium hydroxide solution, the quantity of caustic being that which is sufficient to maintain the desired pH range. At the end of the residence time, the soluble product is filtered at the elevated temperature of 110° C. and the filtrate is passed to a crystallizer which is maintained at room temperature by external cooling means, the drop in temperature resulting in the precipitation of lead fluorine crystals. The lead fluoride crystals are filtered to remove the brine solution and thereafter, after drying in an oven at 110° C. for a period of 1 hour, are admixed with a calcium fluoride salt. The fused salts may then be placed in an electrolysis cell and subjected to electrolysis whereby the lead will pass into a molten state and be recovered therefrom.

EXAMPLE III

In a manner similar to that hereinbefore set forth, 300 cc of a lead sulfide concentrate may be placed in an oven and heated to a temperature of 110° C. for a period of time sufficient to remove substantially all of the water which may be present in the lead sulfide concentrate. The concentrate is then placed in a reactor which is heated to a temperature of 110° C. and subjected to bromination in the presence of bromine gas which may be prepared by heating bromine to an elevated temperature above the boiling point thereof and passing said bromine gas into the reactor. The reactor is continuously rotated in order to insure complete admixture of the lead sulfide concentrate with the bromine gas for a period of 2 hours. At the end of this period, the brominated product is recovered and water washed with 500 cc of water at a temperature of 80° C. The water is separated from the solid product and the latter is then passed to a brine leaching apparatus wherein it is contacted with a brine solution similar to that set forth in Example I above. The leach in the brine solution may be effected at elevated temperatures of about 110° C., the pH of said brine solution being maintained in a range of from about 4 to about 8 by means of the addition of a sufficient amount of sodium hydroxide to accomplish this purpose. After leaching, the pregnant leach liquor is passed at an elevated temperature to a crystallizer which is maintained at room temperature. The drop in temperature will result in the precipitation of lead bromine crystals, said crystals being separated from the brine solution by filtration. After drying the lead bromide crystals, they may then be fused with sodium bromide and the fused sodium bromide-lead bromide mixture may then be subjected to electrolysis at a voltage of 2.4 volts while maintaining the temperature of the cell at 550° C. The molten lead may be recovered by tapping said cell and removing the same to storage.

We claim as our invention:

1. In a process for the production of metallic lead which comprises the steps of:
   (a) drying a lead sulfide source containing at least one metal impurity selected from the group consisting of iron, copper, zinc, and cadmium;
   (b) halogenating the dried lead sulfide source at a temperature in the range of from about 90° to about 120° C.;
   (c) leaching the halogenated mixture with brine;
   (d) filtering the resulting brine solution to separate elemental sulfur and residue from soluble lead halide;
   (e) crystallizing said lead halide; and
   (f) recovering metallic lead by electrolysis, the improvement which comprises water washing the halogenated mixture prior to the brine leaching to remove the small amount of soluble halides of the metal impurity.

2. The process as set forth in claim 1 in which said lead sulfide is chlorinated by treatment with chlorine gas in a dry atmosphere.

3. The process as set forth in claim 1 in which said lead sulfide source is dried at a temperature in the range of from about 100° to about 150° C.

4. The process as set forth in claim 1 in which said washed mixture is leached at a temperature in the range of from about 80° to about 120° C. with a sodium chloride solution.

5. The process as set forth in claim 1 in which said filtration is effected at a temperature in the range of from about 80° to about 120° C.

6. The process as set forth in claim 1 in which the pH of the brine solution is maintained in a range of from about 4 to about 8.

7. The process as set forth in claim 5 in which said pH is maintained in a desired range by the addition of a caustic or acidic solution.

8. The process as set forth in claim 6 in which said caustic solution is sodium hydroxide.

9. The process as set forth in claim 6 in which said acidic solution is hydrochloric acid.

10. The process as set forth in claim 1 in which said electrolysis is effected by utilizing a molten salt mixture.

11. The process as set forth in claim 10 in which said molten salt mixture is a sodium chloride-lead chloride mixture.

12. The process as set forth in claim 11 in which said sodium chloride is present in an amount in the range of from about 20% to about 40% by weight of said mixture and said lead chloride is present in an amount in the range of from about 80% to about 60% by weight of said mixture.

13. The process as set forth in claim 10 in which said molten salt mixture is a potassium chloride-lead chloride mixture.

* * * * *